US010327490B2

(12) United States Patent
Pevenstein

(10) Patent No.: US 10,327,490 B2
(45) Date of Patent: Jun. 25, 2019

(54) ACCESSORY ATTACHMENT SYSTEM

(71) Applicant: Arika Miller Pevenstein, Baltimore, MD (US)

(72) Inventor: Arika Miller Pevenstein, Baltimore, MD (US)

( * ) Notice: Subject to any disclaimer, the term of this patent is extended or adjusted under 35 U.S.C. 154(b) by 288 days.

(21) Appl. No.: 15/097,774

(22) Filed: Apr. 13, 2016

(65) Prior Publication Data

US 2017/0295876 A1 Oct. 19, 2017

(51) Int. Cl.

| | |
|---|---|
| ***A41F 1/00*** | (2006.01) |
| ***A44B 13/02*** | (2006.01) |
| ***A44C 5/20*** | (2006.01) |

(52) U.S. Cl.

CPC ..... *A41F 1/002* (2013.01); *A44B 13/02* (2013.01); *A44C 5/2076* (2013.01)

(58) Field of Classification Search

CPC ..... A41F 1/002; A44C 5/2076; A44B 13/02
See application file for complete search history.

(56) References Cited

U.S. PATENT DOCUMENTS

| | | | | |
|---|---|---|---|---|
| 2006/0048543 | A1 | 3/2006 | Kessler | |
| 2006/0086144 | A1 | 4/2006 | Williams | |
| 2007/0006612 | A1 | 1/2007 | Ignatowski | |
| 2011/0232329 | A1* | 9/2011 | Boyd | A44C 5/2076 63/4 |
| 2012/0044031 | A1* | 2/2012 | Ninomiya | H01F 7/0263 335/219 |
| 2012/0324947 | A1 | 12/2012 | Opperman et al. | |
| 2014/0053374 | A1* | 2/2014 | Jepsen | A44C 5/18 24/303 |
| 2015/0074954 | A1* | 3/2015 | Pruitt | A44C 5/2071 24/303 |
| 2015/0216269 | A1* | 8/2015 | Fuhrman | A44C 5/2071 24/303 |
| 2016/0037883 | A1* | 2/2016 | Keeler | A44C 15/0015 63/1.11 |
| 2016/0058136 | A1* | 3/2016 | Ng | A44C 11/00 63/23 |
| 2016/0066661 | A1* | 3/2016 | Sozio | A44C 5/20 63/12 |
| 2016/0295975 | A1* | 10/2016 | Najarian | A44C 5/20 |

FOREIGN PATENT DOCUMENTS

| | | |
|---|---|---|
| FR | 2987239 | 8/2013 |
| JP | 2015226744 | 12/2015 |

* cited by examiner

*Primary Examiner* — Robert Sandy
*Assistant Examiner* — Louis A Mercado
(74) *Attorney, Agent, or Firm* — Dunlap Bennett & Ludwig PLLC

(57) ABSTRACT

An accessory attachment system that embodies devices and a method for converting clasp-style fasteners to push-pull detachable fasteners, thereby facilitating attachment of accessories having clasp-style fasteners or any accessory having opposing ends so that they are "ready-to-wear".

9 Claims, 1 Drawing Sheet

Fig. 1
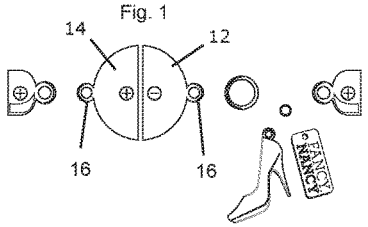
Fig. 2
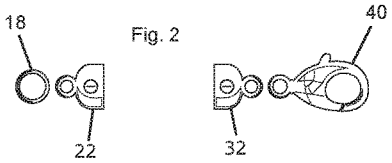
Fig. 5
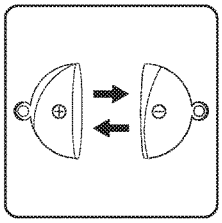
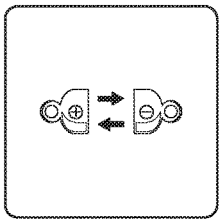
Fig. 6
Fig.3
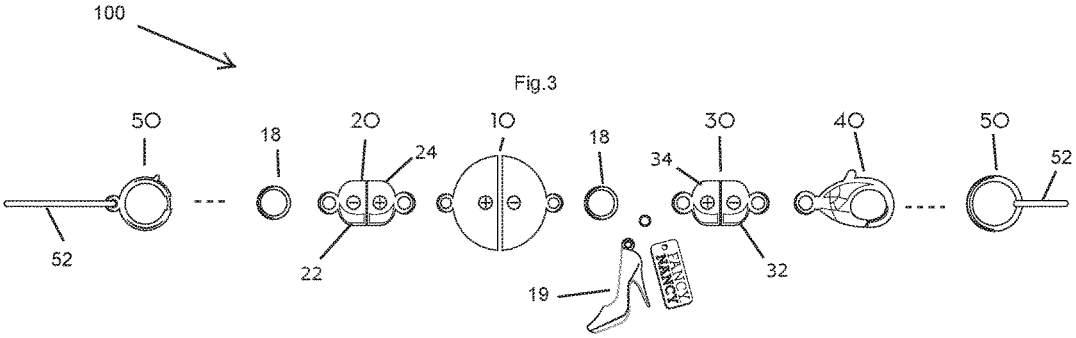
Fig. 4
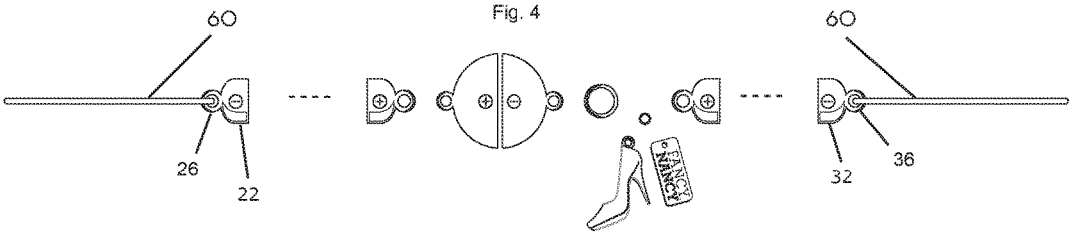

ACCESSORY ATTACHMENT SYSTEM

BACKGROUND OF THE INVENTION

The present invention relates to closure mechanisms and, more particularly, to an accessory attachment system that embodies devices and a method for converting clasp-style fasteners to push-pull detachable fasteners.

People who are physically challenged or otherwise have limited manual dexterity sometimes have difficulty attaching clasp-style accessories to their person, pets or to objects. For example, many necklaces are attached by a small clasp, which most people require practice with or prior exposure to before they can proficiently open and close them. Such individuals could be those with limited fine motor skills as a result of Parkinson's disease or seniors suffering from dementia or Alzheimer's, or anywhere in between. The frustration of such limitations can be heightened when desiring an article or accessory having clasp-style attachments. Typically, in these situations, such a person would need the assistance of a caregiver.

As can be seen, there is an accessory attachment system that embodies devices and a method for converting clasp-style fasteners to push-pull detachable fasteners, thereby enabling individuals that are manually challenged to attach accessories having clasp-style fasteners.

SUMMARY OF THE INVENTION

In one aspect of the present invention, an accessory attachment system including a device having a center assembly with two center magnetic portions, wherein the two center magnetic portions being magnetically attached to each other so as to be movable between an attached condition and a detached condition; and two center connectors, each center connector disposed on one of the two separable center magnetic portions so that in the attached condition the two center connectors are disposed on opposite ends of the center assembly; and two end assemblies, each end assembly having: a first and second end magnetic portions, wherein the first and second end magnetic portions are magnetically attached to each other; and a first and second end connector disposed on each of the first and second magnetic portions, respectively, wherein each first end connector of the two end assemblies is connected to an associated center connector of the two center connectors.

These and other features, aspects and advantages of the present invention will become better understood with reference to the following drawings, description and claims.

BRIEF DESCRIPTION OF THE DRAWINGS

FIG. 1 is an exploded view of an exemplary embodiment of the present invention;

FIG. 2 is an exploded view of an exemplary embodiment of the present invention;

FIG. 3 is an exploded view of an exemplary embodiment of the present invention, shown in use;

FIG. 4 is an exploded view of an exemplary embodiment of the present invention, shown in use;

FIG. 5 is an elevation view of an exemplary embodiment of the present invention, demonstrating a movability from a detached condition to an attached condition; and FIG. 6 is an elevation view of an exemplary embodiment of the present invention, demonstrating how end magnetic portions may removably attach.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an accessory attachment system that embodies devices and a method for converting clasp-style fasteners to push-pull detachable fasteners, thereby facilitating attachment of accessories having clasp-style fasteners or any accessory having opposing ends so that they are "ready-to-wear."

Referring to FIGS. 1 through 6, the present invention may include an accessory attachment system 100 that embodies a center assembly 10, a first end assembly 20 and a second end assembly 30, and a method for converting clasp-style fasteners 50 to push-pull detachable fasteners, thereby enabling individuals with limited manual dexterity to more easily attach accessories having clasp-style fasteners 50.

The center assembly 10 may provide a negative center magnetic portion 12 and a separable positive center magnetic portion 14, wherein the center magnetic portions 12,14 have opposing and thus attracting magnetic polarities, whereby the center magnetic portions 12,14 are movable between an attachable condition when magnetically joined, as illustrated in FIG. 1, and a detached condition when diametrically coaxial forces applied to the two center connectors moves the two center magnetic portions, as illustrated in FIG. 5. Each center magnetic portions 12, 14 may provide a center connector 16 so that when the center magnetic portions 12, 14 are in the attached condition, the respective center connectors 16 are generally opposing or diametrically opposing, as illustrated in FIG. 1.

In the attached condition, the center assembly 10 may define a spheroid or semi-spheroid shape dimensioned for a user having limited manual dexterity to easily grasp, and for easily moving between the detached and attached condition.

The first and second end assemblies 20 and 30 may provide a negative end magnetic portion 22, 32 and a separable positive end magnetic portion 24, 34, respectively, wherein each first and second end magnetic portions 22, 24 and 32, 34 have opposing and thus attractive magnetic polarities so that they are removably attachable when they are facing each other, as illustrated in FIG. 6. Each first and second end magnetic portions 22, 24 and 32, 34 may provide an end connector 26 and 36, respectively, so that when the first and second end magnetic portions 22, 24 and 32 are attached, facing each other, the respective end connectors are generally opposing or diametrically opposing, as illustrated in FIG. 3.

The center and end connectors may be connected to a connector ring 18 so as to provide a greater opening than provided by the center and end connectors, as illustrated in FIG. 3. Such connector rings 18 may further enable the attachment to an accessory 60 or, in other embodiments, of separate charms 19 that enable a user to decorate the attachment system 100.

In certain embodiments of the attachment system 100, clasp connectors 50 may be pre-connected to the opposing ends of a clasp accessory 52, so that an interconnector 40 may connect the associated end connector 26 and the clasp connector 50, as illustrated in FIG. 3. In other embodiments, the connector ring 18 may connect to the clasp connector 50.

Through the end assemblies 20 and 30, the user may interconnect each center magnetic portions 12, 14 to opposing ends of the clasp accessory 52, thereby converting said clasp accessory 52 from a clasp-style attachment mechanism to the push-pull detachable mechanism embodied in the movability of the center assembly 10 between the attached and detached conditions.

In another embodiment of the attachment system 100, one of the pair of magnetic portions, for example the negative end magnetic portion 22 of the pair of end magnetic portions 22 and 24, may be connected to the accessory 60 by way of the associated end connector 26, as illustrated in FIG. 4. Thereby, the attachment system 100 simply connects to a non-clasp-style accessory 60 for enabling its closure and opening through the push-pull detachable mechanism embodied in the movability of the center assembly 10 between the attached and detached conditions.

A method of using the present invention may include the following. The attachment system 100 disclosed above may be provided. A user may secure the attachment system 100—via its end assemblies 20 and 30—to opposing ends of an accessory. In certain embodiments, the end assemblies 20 and 30 may be interconnected to clasp connectors 50 of a clasp accessory 52 by way of a connector ring 18 or an interconnector 40. In other embodiments, the end assemblies 20 and 30 may be secured directly to a non-clasp-style accessory 60, via associated end connectors 26.

In all the embodiments, a manually-limited user may easily grasp the center assembly 10 so as to, without the assistance of a caregiver, move the center assembly 10 between its detached and attached condition via a simple push-pull movement, thereby providing a universally-friendly/non-discriminatory solution for alleviating frustration and empowering individuals, and so maintaining dignity, sense of self, and normalcy for as long as possible in conjunction with a motor-skills handicap or disability of some sort.

In alternative embodiments using the same push-pull movement, the magnetic technology can be applied to an array of accessories, including even break-away safety cat collars.

It should be understood, of course, that the foregoing relates to exemplary embodiments of the invention and that modifications may be made without departing from the spirit and scope of the invention as set forth in the following claims.

What is claimed is:

1. A device, comprising:

a center assembly comprising:

two center magnetic portions;

each center magnetic portion providing a magnetic surface;

the two center magnetic portions being magnetically attachable to each other along the magnetic surfaces so as to be movable between an attached condition and a detached condition; and two center connectors, each center connector extending diametrically away from the magnetic surfaces in the attached condition so that in the attached condition the two center connectors are disposed on opposite ends of the center assembly, wherein diametrically coaxial forces applied to the two center connectors moves the two center magnetic portions to the detached condition; and two end assemblies, each end assembly comprising:

a first and second end magnetic portions, wherein the first and second end magnetic portions are magnetically attached to each other; and a first and second end connectors disposed on each of the first and second end magnetic portions, respectively, wherein each of the first end connector of the two end assemblies is connected to the respective of the two center connectors.

2. The device of claim 1, further comprising at least one of an interconnector or a connector ring connected to each second end connector of the two end assemblies.

3. An accessory attachment system embodying the device of claim 2, further comprising a clasp-style accessory having two opposing clasp connectors, wherein each clasp connector is attached to the at least one of the interconnector or the connector ring connected to each second end connector of the two end assemblies.

4. A method of converting a clasp-style accessory to a push-pull detachable fastener using the device of claim 2, further comprising the steps of:

providing a clasp-style accessory extending between two opposing clasp connectors; and interconnecting each clasp connector to the at least one of the interconnector or the connector ring connected to each second end connector of the two end assemblies of the device.

5. The device of claim 1, further comprising at least one interconnector interconnecting at least one first end connector and the associated center connector.

6. An accessory attachment system embodying the device of claim 1, further comprising a clasp-style accessory having two opposing clasp connectors, wherein each clasp connector is attached to an associated second end connector of each of the two center connectors.

7. A method of converting a clasp-style accessory to a push-pull detachable fastener using the device of claim 1, further comprising the steps of:

providing a clasp-style accessory extending between two opposing clasp connectors; and interconnecting each clasp connector to an associated second end connector of each of the two center connectors of the device.

8. An accessory attachment system embodying the device of claim 1, further comprising an accessory extending between opposing accessory ends, wherein each accessory end is attached to an associated second end connector of each of the two end assemblies.

9. A method of providing a push-pull detachable fastener to an accessory using the device of claim 1, further comprising the steps of:

providing an accessory extending between two opposing accessory end; and interconnecting each accessory end to an associated second end connector of each of the two end assemblies of the device.

* * * * *